US009637263B2

(12) United States Patent
Dickerson et al.

(10) Patent No.: US 9,637,263 B2
(45) Date of Patent: May 2, 2017

(54) FILM-WRAPPED BUNDLE OPENER

(75) Inventors: Homer L. Dickerson, Fort Worth, TX (US); James M. Pippin, Keller, TX (US); Lelan D. Warren, Dallas, TX (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 924 days.

(21) Appl. No.: 13/275,952

(22) Filed: Oct. 18, 2011

(65) Prior Publication Data

US 2012/0096817 A1 Apr. 26, 2012

Related U.S. Application Data

(60) Provisional application No. 61/394,830, filed on Oct. 20, 2010.

(51) Int. Cl.

| | |
|---|---|
| ***B65B 69/00*** | (2006.01) |
| ***B65B 61/18*** | (2006.01) |
| ***B26F 3/00*** | (2006.01) |
| ***B26F 3/06*** | (2006.01) |

(52) U.S. Cl.

CPC ..... *B65B 69/0033* (2013.01); *B26F 3/00* (2013.01); *B26F 3/06* (2013.01); *B65B 69/0066* (2013.01)

(58) Field of Classification Search

CPC ..... B56B 69/00; B56B 61/18; B26D 1/26; B26D 1/46; B26D 7/06; B29C 37/00; B67B 7/34; B65H 20/16; B65H 20/20; B21C 47/16

USPC ..... 53/492, 381.1; 451/5, 8, 9, 10, 296, 299, 451/300, 301

See application file for complete search history.

(56) References Cited

U.S. PATENT DOCUMENTS

| | | | | | |
|---|---|---|---|---|---|
| 2,815,638 | A | * | 12/1957 | Curtiss et al. | 57/1 R |
| 3,095,674 | A | * | 7/1963 | Lee | 451/303 |
| 3,561,908 | A | * | 2/1971 | Reinfeld | 451/70 |
| 3,603,041 | A | * | 9/1971 | McDonald | 451/300 |
| 3,660,950 | A | * | 5/1972 | Takeyama et al. | 451/5 |
| 3,889,442 | A | * | 6/1975 | Grahn et al. | 53/492 |
| 3,939,611 | A | * | 2/1976 | Hesler et al. | 451/1 |
| 4,466,767 | A | * | 8/1984 | Meschi | 414/411 |
| 4,601,134 | A | * | 7/1986 | Hessemann | 451/300 |

(Continued)

FOREIGN PATENT DOCUMENTS

| | | | | |
|---|---|---|---|---|
| AU | WO 9221566 A1 | * | 12/1992 | B65B 69/0033 |
| DE | 202008005109 U1 | | 8/2008 | |

(Continued)

OTHER PUBLICATIONS

PCT International Search Report mailed Feb. 3, 2012 corresponding to PCT International Application No. PCT/US2011/057001 filed Oct. 20, 2011 (13 pages).

*Primary Examiner* — Andrew M Tecco
*Assistant Examiner* — Praachi M Pathak

(57) ABSTRACT

Methods and tools for opening polyfilm-wrapped packages. A tool includes a rubbing surface and a motor configured to move the rubbing surface. The tool includes a power source connected to supply power to the rubbing surface. The rubbing surface is applied to the polyfilm wrapping while being moved to create an opening in the polyfilm wrapping caused at least in part by friction heat. The opening is created without damaging contents of the package.

5 Claims, 3 Drawing Sheets

(56) References Cited

U.S. PATENT DOCUMENTS 4,676,029 A * 6/1987 Palmer ..... B24B 21/008 451/302
4,779,387 A * 10/1988 Reid et al. ..... 451/9
4,798,508 A * 1/1989 Lewis ..... B65B 69/0008 414/412
5,044,124 A * 9/1991 Niimura et al. ..... 451/11
5,167,376 A * 12/1992 Boldrini et al. ..... 242/562
5,238,641 A * 8/1993 Smith ..... 264/280
5,282,346 A * 2/1994 Masuda et al. ..... 53/118
5,441,437 A * 8/1995 Hulstedt ..... 451/1
5,442,895 A * 8/1995 Linson ..... B65B 69/0008 414/412
5,752,359 A * 5/1998 Oord ..... 53/381.2
5,911,666 A * 6/1999 Lancaster et al. ..... 53/492
6,227,088 B1 * 5/2001 Cestonaro et al. ..... 83/176
6,234,871 B1 * 5/2001 Chaloupek et al. ..... 451/11
6,419,569 B1 * 7/2002 Frech et al. ..... 451/355
6,468,132 B2 * 10/2002 Wolf ..... A01F 29/22 451/10
6,634,925 B1 * 10/2003 Grivna ..... 451/5
8,117,733 B2 * 2/2012 Reggiani ..... B65B 69/00 29/564.3
8,317,570 B2 * 11/2012 Kundig ..... B24B 21/004 451/10
8,647,467 B2 * 2/2014 Molinari ..... 156/711
8,784,158 B2 * 7/2014 Weber ..... 451/11
2002/0009960 A1 * 1/2002 Swaddle ..... 451/344
2005/0272356 A1 * 12/2005 Walker et al. ..... 451/355
2007/0169438 A1 7/2007 Brown
2007/0169604 A1 * 7/2007 Brown ..... 83/651
2007/0238401 A1 * 10/2007 Wall et al. ..... 451/355
2009/0202327 A1 * 8/2009 Cory et al. ..... 414/412
2012/0131889 A1 * 5/2012 Corradi ..... B65B 69/00 53/492

FOREIGN PATENT DOCUMENTS

EP 0249562 A1 12/1987
FR 2253356 A5 6/1975
WO WO 9221566 A1 12/1992

* cited by examiner

FILM-WRAPPED BUNDLE OPENER

CROSS-REFERENCE TO OTHER APPLICATIONS

This application claims the benefit of the filing date of U.S. Provisional Patent Application 61/394,830, filed Oct. 20, 2010, which is hereby incorporated by reference.

TECHNICAL FIELD

The present disclosure is directed, in general, to machines and methods for opening wrapped bundles.

BACKGROUND OF THE DISCLOSURE

Improved bundle opening systems are desirable.

SUMMARY OF THE DISCLOSURE

Various embodiments include methods and tools for opening polyfilm-wrapped packages. A tool includes a rubbing surface and a motor configured to move the rubbing surface. The toot includes a power source connected to supply power to the rubbing surface. The rubbing surface is applied to the polyfilm wrapping while being moved to create an opening in the polyfilm wrapping caused at least in part by friction heat. The opening is created without damaging contents of the package.

The foregoing has outlined rather broadly the features and technical advantages of the present disclosure so that those skilled in the art may better understand the detailed description that follows. Additional features and advantages of the disclosure will be described hereinafter that form the subject of the claims. Those skilled in the art will appreciate that they may readily use the conception and the specific embodiment disclosed as a basis for modifying or designing other structures for carrying out the same purposes of the present disclosure. Those skilled in the art will also realize that such equivalent constructions do not depart from the spirit and scope of the disclosure in its broadest form.

Before undertaking the DETAILED DESCRIPTION below, it may be advantageous to set forth definitions of certain words or phrases used throughout this patent document: the terms "include" and "comprise," as well as derivatives thereof, mean inclusion without limitation; the term "or" is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, whether such a device is implemented in hardware, firmware, software or some combination of at least two of the same. It should be noted that the functionality associated with any particular controller may be centralized or distributed, whether locally or remotely. Definitions for certain words and phrases are provided throughout this patent document, and those of ordinary skill in the art will understand that such definitions apply in many, if not most, instances to prior as well as future uses of such defined words and phrases. While some terms may include a wide variety of embodiments, the appended claims may expressly limit these terms to specific embodiments.

BRIEF DESCRIPTION OF THE DRAWINGS

For a more complete understanding of the present disclosure, and the advantages thereof, reference is now made to the following descriptions taken in conjunction with the accompanying drawings, wherein like numbers designate like objects, and in which.

DETAILED DESCRIPTION

Figure 1:
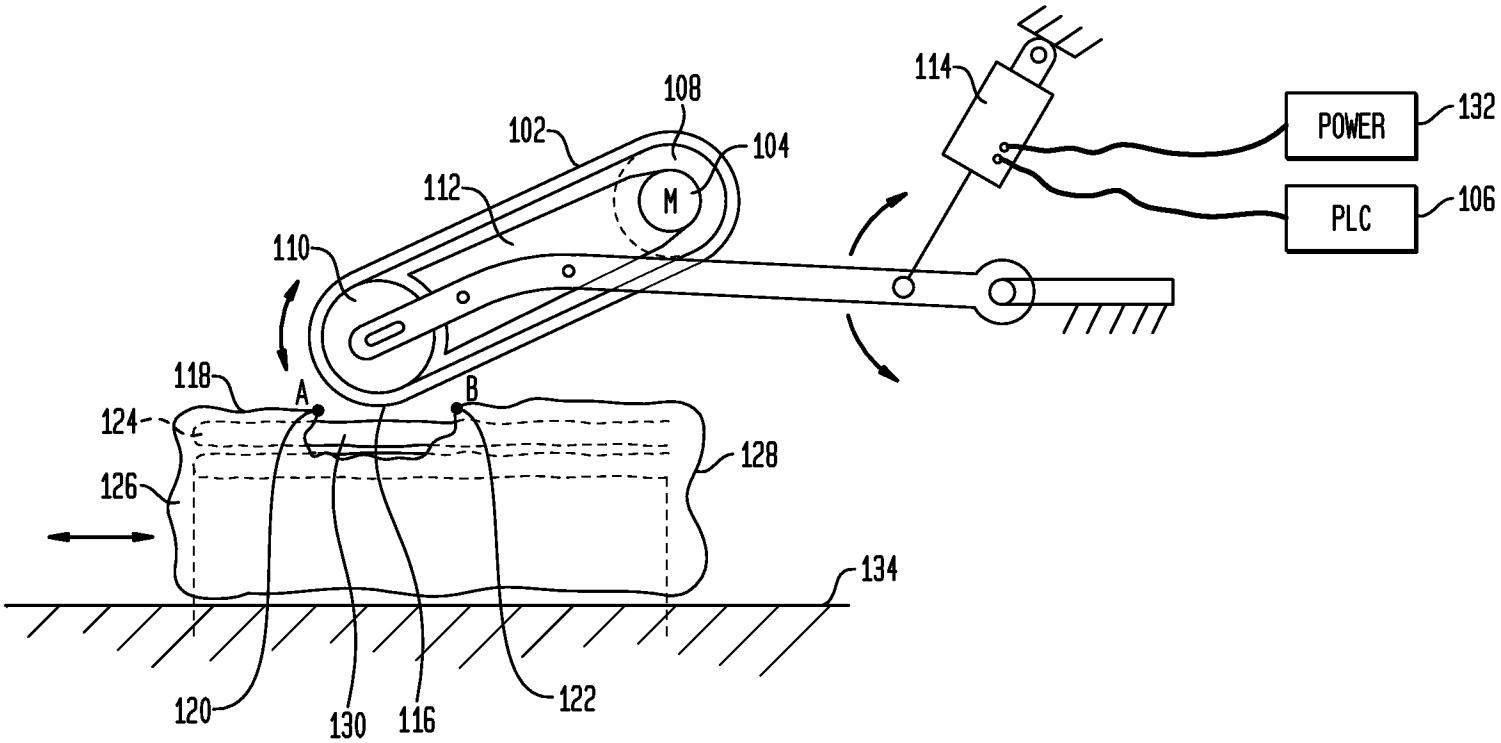
FIG. 1 illustrates a machine-tool implementation of a film opener in accordance with disclosed embodiments.
Figure 2:
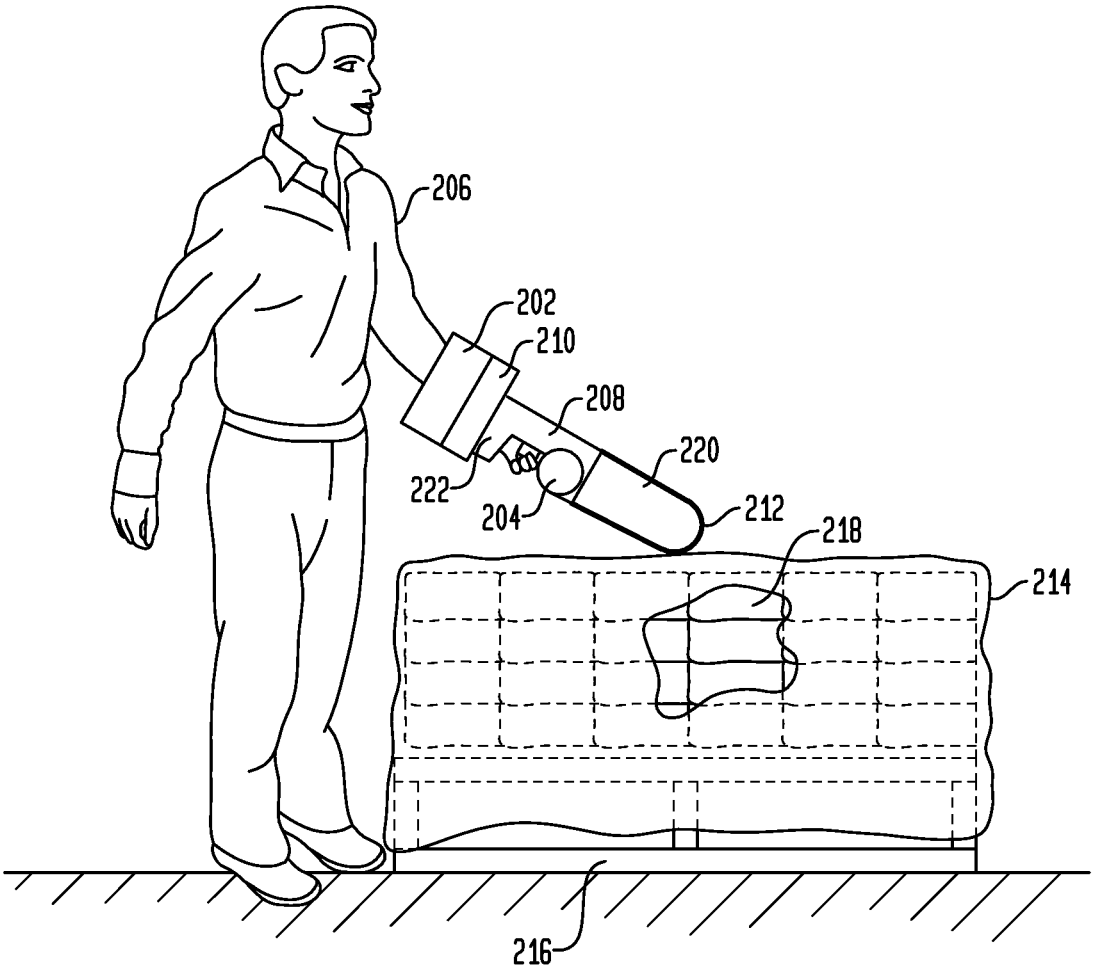
FIG. 2 illustrates a hand-operated implementation of a film opener in accordance with disclosed embodiments.
Figure 3:
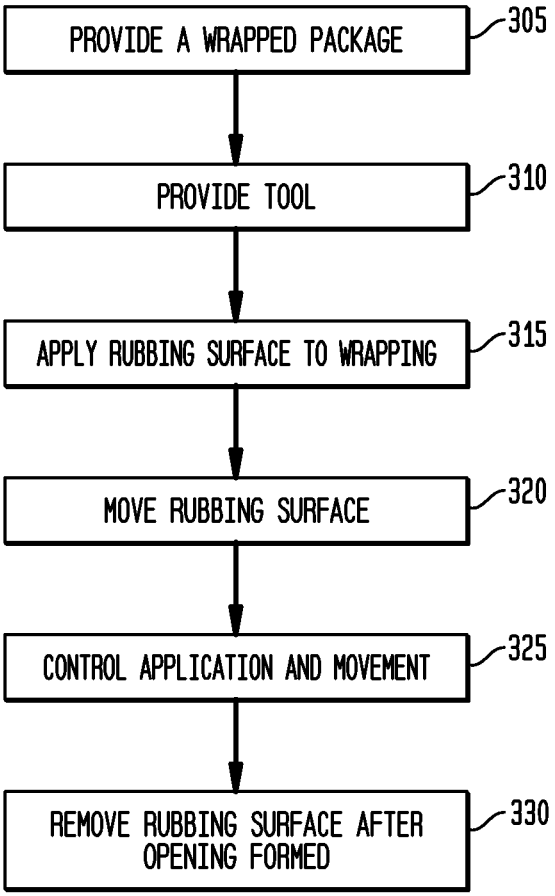
FIG. 3 depicts a flowchart of a process in accordance with disclosed embodiments.

FIGS. 1 through 3, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged device. The numerous innovative teachings of the present application will be described with reference to exemplary non-limiting embodiments.

As used herein, "poly film" or "polyfilm" refers to polyurethane, polyolefin, polythene, polyethene, polyethylene, poly(methylene), or similar thermoplastic films that can be used for wrapping packages and other items.

Opening polyfilm wrapped bundles or pallets is a painstaking task. Over decades, material handlers have used a variety of knife types to slash at film so it can be opened and removed. Many times the contents within the film are cut and damaged in the process of opening polywrapping to remove the contents. Many injuries have occurred while cutting polyfilm and similar materials. The depth of the cut is difficult to control using a blade, making it necessary to grasp and lift poly film away from the contents with one hand while cutting with the other.

Disclosed embodiments include a friction opener that uses a more passive effect to open film. A rubbing action generates concentrated friction heat along with tension forces from the belt traction to weaken and tear the poly film. Because the rubbing action of a belt action is more passive, the polyfilm can be removed from a broad range of contents without harming the contents, using a broad range of belt speeds, forces, and rubbing dwell-time parameters. Magazines, paper, cardboard, plastic bottles, glass, and metal cans are typical examples of film-wrapped items that are not harmed by the controlled rubbing of a friction belt using techniques disclosed herein.

In hand-operated film opener implementations, the material handler quickly learns the range of belt speeds and dwell times that are effective to open film around pallets or items without damaging the contents.

In automated film opener implementations, the opener controller can be preprogrammed with parameters to allow the controlled automatic opening of items including polywrapped magazine bundles.

In various embodiments, the film opener can be integrated into an automation platform, mounted in a stand, or handheld.

FIG. 1 illustrates a machine-tool implementation of a film opener in accordance with disclosed embodiments. In this example, the machine tool includes a high-friction rotating belt 102. The belt 102 is configured to be driven by a variable-speed motor 104 using a drive roller 108. Motor 104 is capable of producing a high number of revolutions per minute (RPM) on a simple on/off input, or can be controlled by a controller 106, such as a programmable logic controller (PLC) or otherwise. Belt surface speed is a function of the diameter of drive roller 108 and the RPM of motor 104.

The circumference of belt 102 is formed by tensioning belt 102 between idler roller 110 and driver roller 108, held in position and apart by frame 112. When powered, actuator 114 lowers frame 112 on which belt 102 is supported, thereby lowering the end of the belt. A power source 132 can provide power to controller 106 and actuator 114.

Segment 116 of belt 102 comes in contact with surface 118 of wrapping 128, which is made from poly film or a similar material. Relative motion and normal threes acting between belt 102 and surface 118 simultaneously generates heat and a pulling action on surface 118, resulting in a tear formed at locations 120 and 122.

Relative speed between belt 102 and surface 118, the thickness and material composition of surface 118, the composition and profile of belt segment 116, and the normal force generated by powered actuator 114 determines the dwell time required to generate friction heat and to pull and tear surface 118 at locations 120 and 122 to produce opening 130. "Dwell time" refers to the duration that belt 102 is held against surface 118.

A range of acceptable belt speeds, normal force, and dwell time is associated with known characteristics of wrapping 128 and contents 124 of wrapped package 126 under the surface 118. Coordinating these factors allows surface 118 to be opened without damage to a broad range of contents 124 when wrapping 128 is poly film or a similar material.

Speed acting between belt 102 and surface 118, the normal force, and the dwell time can be coordinated manually by a skilled operator, or can be preprogrammed into controller 106, to reliably open surface 118 while preventing damage to contents 124 of package 126.

In some embodiments, a conveyor 134 can be included to transport package 126 into position for unwrapping.

FIG. 2 illustrates a hand-operated implementation of a film opener in accordance with disclosed embodiments. In this example, a rechargeable battery 202 generates power to motor 204. The power is controlled by an operator 206 using a power control 208, such as a variable-speed trigger, with optional speed control assistance by a controller 210. Operator 206 can vary the speed of belt 212 by variably depressing trigger 208 or by setting speed limiters, such as in controller 210 or by a fixed trigger stop, to control the speed of motor 204.

In addition, operator 206 applies a correct range of normal forces and dwell times relative to the speed of belt 212 to open wrapper 214 of package 216 without damaging contents 218.

Film opener 220 includes battery 202, motor 204, belt 212, optional controller 210, and power control 208. Battery 202 is connected to power motor 204 and controller 210, and power control 208 controls the power to the motor 204, optionally at least partially under control of controller 210. A frame 220 extends from the battery 202, controller 210, motor 204, a grip 222, and power control 208 to conform the circumference of belt 212 in a desired shape and drive arrangement.

Of course, those of skill in the art will recognize that the disclosure is not limited to the two exemplary implementations described above. Various draft arrangements and geometries are possible in accordance with the disclosed techniques and within the abilities of those of skill in the art.

For example, various embodiments include methods and apparatuses that apply a manual or computer-controlled rubbing action to a plastic film or similar material in a manner that results in permanently wrinkling, tearing, or severing a series of one or more layers of film without harming any contents contained within.

Various embodiments can include a rubbing surface within a range of friction, arranged on a rod, block, belt, or similar device, and which is placed manually or automatically against the film.

Various embodiments can include a range of forces applied against the film, applied by spring, counter-weight, powered actuator, operator thrust, or a combination of these.

Various embodiments can include a relative direction, speed, and frequency of movement between the rubbing surface and the film, generated by movement of the rubbing surface or film in a linear, rotational, orbital, vibratory, or combination action.

Various embodiments can include discrete or collective control by automatic or manual means which control the parameters such as the position of the rubbing surface, force of the rubbing surface, the direction, speed, frequency, or dwell time of movement of the rubbing surface relative to the film on which it acts.

FIG. 3 depicts a flowchart of a process in accordance with disclosed embodiments.

A wrapped package is provided that is wrapped at least in part in a polyfilm outer wrapping and contains contents (step 305). The contents can be, for example, magazines or other mailpieces, paper, cardboard, plastic bottles, glass, or metal cans, among others. The outer wrapping can be a polyfilm. Providing the wrapped package can include transporting the wrapped package on a conveyor. The wrapped package can also contain or be transported on a pallet. The wrapped package need not be a container around the contents; the contents themselves can be the package and be wrapped in the outer wrapping.

A tool is provided having a rubbing surface (step 310). The tool can be a handheld tool or a machine tool. The tool can include any of the components or features discussed above. The rubbing surface can be arranged on a rod, block, belt, or similar device.

The rubbing surface can be applied to the outer wrapping (step 315). The application can include a range of forces applied against the outer wrapping, and can be applied by spring, counter-weight, powered actuator, operator thrust, or a combination of these.

The rubbing surface can be moved relative to the outer wrapping in a motion to create friction with the outer wrapping (step 320). In most cases, this will be moving the rubbing surface, but could alternately include moving the wrapped package. The motion can be linear, rotational, orbital, vibratory, or a combination of these. This movement creates a frictional heat, melting, or tearing force on the outer wrapping, but does not damage the contents.

The application and movement can be controlled (step 325). The control can be discrete or collective control by a hardware controller or by an operator. The control can include controlling the position of the rubbing surface, the force applied between the rubbing surface and the outer wrapping, or the direction, speed, frequency, or dwell time of movement of the rubbing surface relative to the outer wrapping.

The moving rubbing surface can be removed from the outer wrapping after an opening is created in the outer wrapping (step 330). This can be after a predetermined dwell time. The opening can be created by melting or tearing caused by the application of the moving rubbing surface to the outer wrapping, and is typically caused at least in part by friction heat generated by the motion of the rubbing surface against the outer wrapping.

Unless specifically described herein, no steps or components should be regarded as essential or necessary for inclusion in the claims below. Further, in various embodiments, the steps above can be performed concurrently, sequentially, or in a different order, unless specified otherwise.

It is important to note that while the disclosure includes a description in the context of a fully functional system, those skilled in the art will appreciate that at least portions of the mechanism of the present disclosure are capable of being distributed in the form of a computer-executable instructions contained within a machine-usable, computer-usable, or computer-readable medium in any of a variety of forms to cause a system to perform processes as disclosed herein, and that the present disclosure applies equally regardless of the particular type of instruction or signal bearing medium or storage medium utilized to actually carry out the distribution. Examples of machine usable/readable or computer usable/readable mediums include: nonvolatile, hard-coded type mediums such as read only memories (ROMs) or erasable, electrically programmable read only memories (EEPROMs), and user-recordable type mediums such as floppy disks, hard disk drives and compact disk read only memories (CD-ROMs) or digital versatile disks (DVDs). In particular, computer readable mediums can include transitory and non-transitory mediums, unless otherwise limited in the claims appended hereto.

Although an exemplary embodiment of the present disclosure has been described in detail, those skilled in the art will understand that various changes, substitutions, variations, and improvements disclosed herein may be made without departing from the spirit and scope of the disclosure in its broadest form. In the processes described above, various steps may be performed sequentially, concurrently, in a different order, or omitted, unless specifically described otherwise.

None of the description in the present application should be read as implying that any particular element, step, or function is an essential element which must be included in the claim scope: the scope of patented subject matter is defined only by the allowed claims. Moreover, none of these claims are intended to invoke paragraph six of 35 USC §112 unless the exact words "means for" are followed by a participle.

What is claimed is:

1. A method for automated opening polyfilm wrapping on a package, comprising:

providing a plurality of packages moving on a conveyer that are each wrapped at least in part in a polyfilm wrapping, wherein the contents of each package are one of magazines, mailpieces, paper, cardboard, bottles, glass, or cans;

providing an automated machine tool having a rubbing surface, the machine tool comprising a hardware controller preprogrammed with parameters to allow controlled automatic opening of the package, wherein the rubbing surface is a friction belt configured to be rotated by a motor, wherein the friction belt is mounted on a drive roller driven by the motor and an idler roller, the friction belt being supported by a frame;

lowering the frame by an actuator coupled to the frame, thereby lowering an end of the friction belt, and a section of the end of the friction belt comes in contact with a surface of the polyfilm wrapping of each package on the conveyer;

applying the rubbing surface to the polyfilm wrapping of each package on the conveyer;

controlling movement, using the hardware controller, of the rubbing surface and application of the rubbing surface to the polyfilm wrapping of each package, the hardware controller being configured to control the motor and the actuator; and creating an opening in the polyfilm wrapping of each package caused substantially by friction heat via the rubbing surface rotating and moving relative to the polyfilm wrapping of each package, without damaging the contents of each package, the parameters preprogrammed in the hardware controller including a dwell time required to generate the friction heat to produce the opening of each package.

2. The method of claim 1, wherein the rubbing surface is applied to the polyfilm wrapping according to the parameters preprogrammed into the hardware controller, the parameters further including one or more of a position of the rubbing surface, a force of the rubbing surface, a direction of the movement of the rubbing surface, a speed of the movement of the rubbing surface, or a frequency of the movement of the rubbing surface.

3. The method of claim 1, wherein the moving of the rubbing surface is one or more of a linear, rotational, orbital, or vibratory movement.

4. The method of claim 1, wherein the machine tool automatically applies the friction belt to the polyfilm wrapping for the dwell time sufficient to create the opening.

5. The method of claim 4, wherein the dwell time is determined based on a relative speed between the friction belt and the polyfilm wrapping, a thickness and material composition of the polyfilm wrapping, a composition and profile of the friction belt, and a force at which the friction belt is applied to the polyfilm wrapping.

* * * * *